US009700992B2

(12) United States Patent
Ficai

(10) Patent No.: US 9,700,992 B2
(45) Date of Patent: Jul. 11, 2017

(54) FINISHING GRINDING WHEEL AND A FORMING METHOD THEREOF

(71) Applicant: Paolo Ficai, Parma (IT)

(72) Inventor: Paolo Ficai, Parma (IT)

( * ) Notice: Subject to any disclaimer, the term of this patent is extended or adjusted under 35 U.S.C. 154(b) by 152 days.

(21) Appl. No.: 14/595,659

(22) Filed: Jan. 13, 2015

(65) Prior Publication Data

US 2015/0196992 A1 Jul. 16, 2015

(30) Foreign Application Priority Data

Jan. 15, 2014 (IT) ..... RE2014A0001

(51) Int. Cl.

| | |
|---|---|
| ***B24D 5/04*** | (2006.01) |
| ***B24D 18/00*** | (2006.01) |
| ***B24D 3/00*** | (2006.01) |
| ***B24D 7/04*** | (2006.01) |

(52) U.S. Cl.

CPC ..... *B24D 5/04* (2013.01); *B24D 3/002* (2013.01); *B24D 7/04* (2013.01); *B24D 18/0009* (2013.01); *B24D 18/0054* (2013.01)

(58) Field of Classification Search

None

See application file for complete search history.

(56) References Cited

U.S. PATENT DOCUMENTS

| | | | | |
|---|---|---|---|---|
| 3,041,797 | A | 7/1962 | Moffly | |
| 2007/0003777 | A1* | 1/2007 | Iwasa | B32B 27/08 428/523 |
| 2010/0190424 | A1* | 7/2010 | Francois | B24D 5/123 451/548 |
| 2013/0093125 | A1* | 4/2013 | Furey | B29C 45/14065 264/503 |

FOREIGN PATENT DOCUMENTS

| | | |
|---|---|---|
| EP | 0744248 A1 | 11/1996 |
| JP | S5023178 Y1 | 7/1975 |

OTHER PUBLICATIONS

English Translation of JP 50 023178, Jul. 2016 by FLS, Inc.*

* cited by examiner

*Primary Examiner* — Joseph J Hail
*Assistant Examiner* — Brian Keller
(74) *Attorney, Agent, or Firm* — Volpe and Koenig, P.C.

(57) ABSTRACT

A grinding wheel (20) includes at least a first reinforcing mesh (21) completely incorporated in at least a first layer of abrasive mixture (22) and at least a support element in contact with the first reinforcing mesh (21). The reinforcing element is constituted by an auxiliary mesh (23) provided with a face (232) in direct contact with the first reinforcing mesh (21).

14 Claims, 5 Drawing Sheets

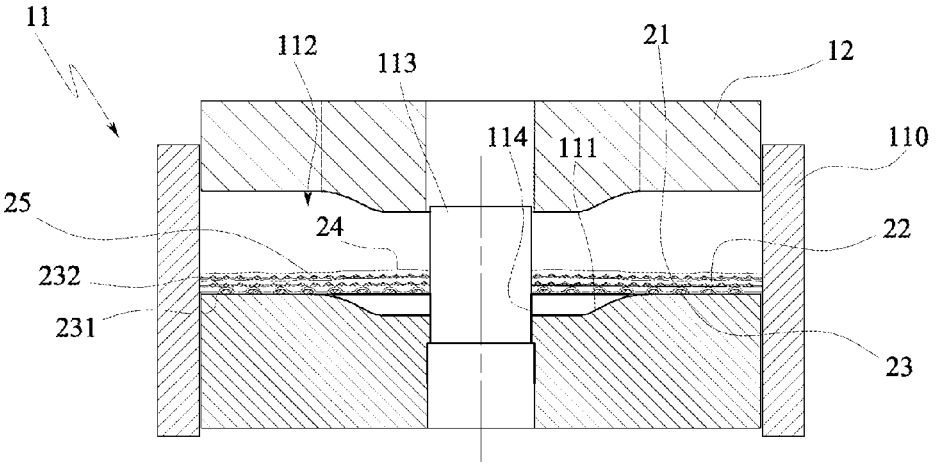
FIG.9
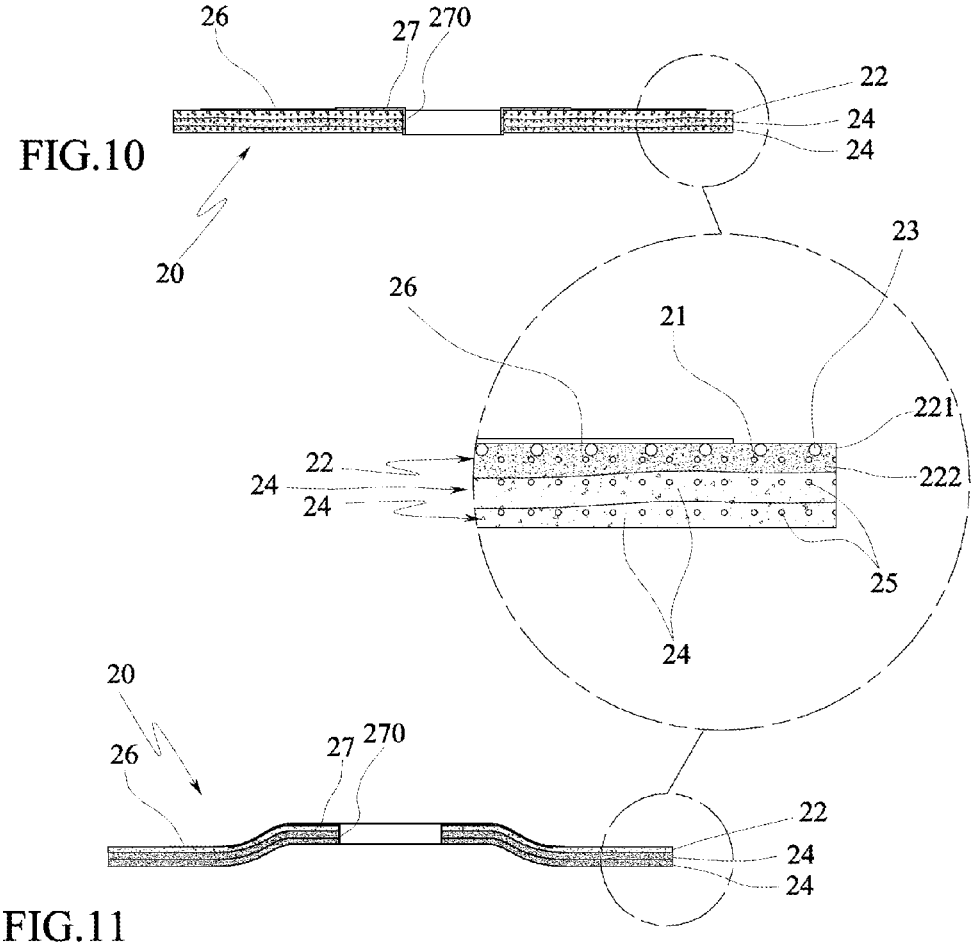
FIG.10
FIG.11

FINISHING GRINDING WHEEL AND A FORMING METHOD THEREOF

FIELD OF THE INVENTION

The present invention relates to a grinding wheel having a depressed or flat center and a method for production of the grinding wheels.

In greater detail, the present invention relates to a finishing grinding wheel and a method for realizing the grinding wheel.

BACKGROUND

As is known, the prior art includes disc-shaped abrasive grinding wheels having a depressed or flat center, conical, semi-flexible and exhibit an external diameter substantially comprised between 30 and 230 mm, especially used on high-speed portable electric grinding wheels, powered by electricity or compressed air (60-100 m/s peripheral velocity), also known as finishing grinding wheels, for carrying out grinding and/or cutting operations, which are essentially constituted by an abrasive mixture reinforced by armatures constituted by one or more textile meshes, on or more annular metal elements, commonly known as rings, which delimit the fastening hole of the grinding wheel to the shaft of the milling machine, and possibly by a paper label or another identifying plate adhering to one of the two faces of the grinding wheel (usually the convex face).

The abrasive mixture is generally constituted by grains of abrasive material (light green, dark green or black silicon carbide, corundum, zircon-modified corundum, semi-friable, red-brown, white, pink, ruby, ceramicated, monocrystalline, sol-gel abrasives or sintered ceramics or others besides) having predefined particle size (normally measured in mesh) which are mixed with resins, for example phenolic, liquid and/or in powder form and possibly modified with epoxy resins, and/or others, possibly modified with organic compounds and/or vegetable or synthetic compounds, and other types of polyimide resins etc., and with additives and fillers.

The reinforcing meshes are normally glass-fiber fabrics but other types of fibers could be used, such as carbon, Kevlar or others; the textile meshes, around 1.5 m in height, are first immersed in a solution of liquid resins and solvents, squeezed between pairs of rollers and dried in appropriate ovens internally of which the resin dries without polymerizing (polymerization is then completed in the baking oven together with the baking of the grinder).

The meshes, thus-impregnated with resin and dried, are used for the blanking (or other cutting method) of the mesh discs required for reinforcing the grinding wheels.

The meshes can possibly be pre-glued to a paper sheet or a slim polymer sheet, or also to the labels.

The annular elements defining and delimiting the attaching hole of the grinding wheel are constituted by a small circular crown plate, or a plate of another shape, such as for example square or polygonal, from the internal hole of which a hollow cylindrical or non-cylindrical appendage extends; the plate adheres to one of the two faces of the grinding wheel, while the hollow appendage inserts in the hole of the grinding wheel, delimiting the internal wall.

The labels are made of paper or foil or another synthetic material and they normally have a circular crown shape (though they could have a different shape) and can occupy either the whole face of the grinding wheel or a limited area of the face to which the identifying and informative data of the grinding wheel can be attached.

Grinding wheels are produced by pressing in dies constituted by a ring in which a superiorly-open forming cavity is housed, known as a female, and by a complementary punch, known as a male.

A concave recess is formed in the central portion of the bottom of the forming cavity (the female), from which concave recess a pin rises for definition of the attachment hole of the grinding wheel; a protrusion is fashioned in the central portion of the punch (the male), which protrusion couples with the recess and internally of which a hole is afforded in which the pin is inserted during the active pressing step.

The method currently known for the production of grinding wheels consists essentially of inserting a first annular element (washer) on the pin, defining the attachment hole of the grinding wheel, the plate of the element resting on the bottom of the concave recess and the cylindrical appendage facing upwards, and of resting either a first reinforcing mesh or a suitable paper label on the bottom of the forming cavity, the reinforcing mesh being provided with glued paper having a function of supporting the mixture; further consisting in depositing a first layer of abrasive mixture, in depositing for example a second reinforcement mesh, in inserting, on the pin, an eventual second annular element (washer) defining the hole opposite the first, and in pressing, with the punch (male), at pressures in the order of 100-300 Kg/cm2 and releasing the pressed wheel from the die.

Depending on the thickness desired for the grinding wheel, successive layers of abrasive mixture alternated with supplementary reinforcement meshes can be realized on the first layer of abrasive mixture deposited.

The first mesh placed, i.e. the lowest mesh or the "backbone", the mesh which in the case of a depressed-center wheel, is located on the outside of the grinding wheel, can be placed directly on the bottom of the forming cavity of the matrix coupled to a sheet of paper material, or by interposing an annular paper label or a like element between the bottom of the forming cavity and the first mesh.

The label or the bottom of the forming cavity performs the function of containment and support of the abrasive mixture deposited internally of the forming cavity, and in order to perform this function, must exhibit an adequate rigidity.

An example of known abrasive wheel is shown in the prior document JP S50 23178, in which the lowest mesh, which is the first reinforcement mesh, has links equal in size to the links of the other reinforcement meshes (i.e. the second reinforcement mesh), therefore the amount of abrasive mixture that encompasses the rear of the first reinforcement mesh and which encompasses the second reinforcement mesh, adjacent to the first, is very limited and not very resistant.

The pressed grinding wheel once removed from the die is subsequently subjected to heating at a temperature slowly rising from 80° C. to 125° C.; in these conditions the resins of the abrasive mixture and the resins impregnating the reinforcement mesh or meshes become fluid, "merging" together and "interpenetrating"; in this way the mixture adheres to the mesh or meshes and together with them creates a single block.

A subsequent re-heating of up to 180-190° C. (but even to lower temperatures) determines the process of irreversible polymerization of the resin.

These known methods for the production of grinding wheels and the grinding wheels obtainable with the method are not free of drawbacks.

A first drawback consists in the fact that, in a case of production of depressed-center grinding wheels, during the depositing of the abrasive mixture internally of the cavity, at least the central portion of the first reinforcing mesh or the labels rested on the bottom of the cavity, which portion is at the concave recess of the cavity itself, yields and flexes below the weight of the abrasive mixture deposited, which is a cause of undesired variations of density and thickness of the central portion of the grinding wheel with respect to the peripheral portion thereof.

A further drawback of the known methods consists in the fact that the adhesion of the first reinforcing mesh, the one deposited on the bottom of the forming cavity, to the abrasive mixture, is limited and incomplete; this is due both to the fact that the abrasive mixture adheres to a single face (the upper face) of the first reinforcing mesh or, at most, penetrates into the mesh openings and glues the flanks of the mesh wired, leaving the face resting on the bottom of the cavity and/or on the label uncovered, and also is due to the very limited adhesive properties of phenolic or phenol-epoxy resins normally used.

This drawback is most felt in a case where the first reinforcing mesh is a mesh glued to a slim paper sheet; in this case, the sheet obstructs the spreading of the abrasive mixture to below the links of the mesh, preventing the mesh from sinking into the grinding wheel.

Known grinding wheels exhibit a further drawback consisting in the fact that, particularly when used for grinding operations, the upper edge thereof (the convex side or in any case the back side) is subject to irregular and excessive wear due to the over-stress it is subjected to (vibration, shock, non-planar contact). This drawback is even more clearly noted in grinding wheels of limited thickness, of the order of 3-4 mm (cutting and grinding wheels), the flexibility of which, in fact, exacerbates the over-stress when used in grinding.

It has been found that by using layers of abrasive mixtures of different particle sizes, it is possible to improve resistance to over-stress of the edge; this is done by using, for the first layer of abrasive mixture deposited in the die (the backbone layer, convex or planar, depending on the grinding wheel), mixtures with fine abrasives (36-46-60 mesh) and high-resistance resins.

It has also been also found that it is sufficient to sink and immerse the first mesh, the mesh resting on the bottom of the forming cavity of the die, internally of the first layer of deposited abrasive mixture, even if only for a thickness of less than 1 mm, so as to obtain a significant improvement in the resistance to stress of the upper edge of the grinding wheel.

This operation, however, has been found to be particularly delicate.

A method aimed at achieving this result could be to deposit, on the bottom of the cavity of the forming die, a thin layer of abrasive mixture on which to rest the first mesh.

However, given the limited thickness involved, this method is practically difficult to implement and difficult to control, particularly in the case where abrasive mixtures have to be used which contain coarse abrasives, and does not guarantee the repeatability and constancy of results, and requires an expenditure of time and resources that bear heavily on production costs. In addition, there is always the problem of supporting the material at the position of the concave cavity.

To obviate the above drawbacks the present applicant proposed a solution described in Italian patent no. IT 1 334 480.

In particular, to obviate the problem of incorporating the first reinforcing mesh, namely the "backbone" reinforcing mesh, in a layer of abrasive material, even of only a limited thickness, a production method of the grinding wheel was developed that that included following steps:

inserting a support element on a pin for forming an attachment hole of a grinding wheel emerging from the forming cavity of a die matrix, wherein the support element comprises a plate in which a through-hole is defined for insertion on the core and is provided with a first face intended to at least partially rest on the bottom of the cavity, and an opposite second face where projections rising from the second face are defined, which have a predefined height;

laying, internally of the cavity, at least a first reinforcing mesh so that so that it rests on the rising projections of the plate and remains separated from the bottom of the forming cavity at least at a height equal to the height of the projections;

depositing a predefinable quantity of abrasive mixture which incorporates the first reinforcing mesh suspended from the bottom of the forming cavity, and pressing the support element, the first reinforcing mesh and the layer of mixture so as to obtain the grinding wheel.

However, though widely used and with excellent results, even this solution is not without drawbacks, the first of which is certainly the cost of the preparation of the suitably-shaped support elements provided with the projections.

A further drawback encountered in this solution is the fact that the reinforcing mesh is supported at discrete points thereof in the central area; therefore the periphery of the mesh, under the weight of the abrasive mixture before it penetrates the spaces between the meshes of the first reinforcing mesh and goes to rest on the bottom, defining a support layer for the mesh, can flex and thus lose the substantial planarity thereof.

In order to limit this drawback, the bottom of the forming cavity of the die is machined to define respective projections on which the reinforcing mesh rests; this not only increases the cost of the die, but also defines cavities in the finished grinding wheel.

An aim of the present invention is to obviate the above-mentioned drawbacks in the prior art, with a solution that is simple, rational and relatively inexpensive.

These aims are attained by the characteristics of the invention reported in the independent claims. The dependent claims delineate preferred and/or particularly advantageous aspects of the invention.

SUMMARY

In particular, the invention discloses a grinding wheel which comprises at least a first reinforcing mesh completely incorporated into at least a first layer of abrasive mixture and at least a support element in contact with the first reinforcing mesh.

According to the invention, the reinforcing element comprises an auxiliary mesh provided with a face in direct contact with the first reinforcing mesh.

With this solution, the first reinforcing mesh, i.e. the back strengthening mesh or "backbone", is completely incorporated into the first layer of abrasive mixture which defines the backbone of the grinding wheel, and this makes the structure significantly more solid and resistant.

Therefore, with this solution a benefit is obtained in terms of resistance of the backbone layer of the grinding wheel as well as a benefit in terms of regularity of wear of the backbone layer during use; in practice this layer of abrasive mixture located posteriorly of the grinding wheel does not in use chip or lose pieces of abrasive material as it is more resistant, and at the same time there is an economical benefit, as it enables obtaining these results with a more economic specification than those at present used to maintain the backbone mesh suspended internally of the die in order for the backbone to be totally incorporated into the backbone layer of mixture.

In a further aspect of the invention, a further face, i.e. the rear backbone face, of the auxiliary mesh at least partially emerges (as it is substantially level with the rear face of the first layer of abrasive mixture) from the first layer of abrasive mixture.

The auxiliary mesh preferably exhibits mesh passages that are larger than those of the first reinforcing mesh.

With this solution quite substantial volumes of abrasive mixture collect between the large mesh passages of the auxiliary mesh which posteriorly incorporate, together with the auxiliary mesh itself, the whole first reinforcing mesh, i.e. the backbone mesh which has the function of supporting the first layer of abrasive mixture.

For these aims, the auxiliary mesh advantageously exhibits mesh passages comprised between 1×1 cm and 3×3 cm, preferably 2×2 cm.

Further, in an aspect of the invention, the auxiliary mesh exhibits a thickness substantially comprised between 0.5 and 2 mm, preferably 1 mm.

For example, the maximum thickness can be obtained at only the nodes of the auxiliary mesh, or at the whole surface of the auxiliary mesh, or in other points distributed in the surface of the auxiliary mesh.

With this solution, the first layer of abrasive mixture exhibits a rear portion (back portion) that is sufficiently thick to incorporate the first reinforcing mesh and to prevent any detachments of material in use.

The auxiliary mesh is advantageously substantially disc-shaped with an external diameter that is substantially comprised between 0.7 and 1.0 times the external diameter of the abrasive mixture.

The presence of the auxiliary mesh together with the single reinforcing mesh (the first reinforcing mesh) further enables creating, in practice, two (semi)layers of "backbone" abrasive mixture, respectively a front portion and a rear portion to the first reinforcing mesh with a simple depositing of abrasive mixture (because the grains pass below the suspended reinforcing mesh and create a rear portion between the links of the meshes of the auxiliary mesh).

This fact is particularly advantageous and appreciable in the grinding wheels realized using forming plants provided with only one or two depositing stations of abrasive mixture (for example, one with fine grains for the back and a coarser grain for the front portion of the grinding wheel), as the number of layers the grinding wheel is made up of is increased with a same number of depositing operations.

In a further aspect, beyond the first reinforcement mesh and the first layer of abrasive mixture, the grinding wheel comprises at least a second reinforcing mesh incorporated in a respective second layer of abrasive mixture (obtained by depositing a second abrasive mixture, for example coarser, for example in a second depositing station), in which at least one from between the second reinforcing mesh and the second layer of abrasive mixture is in contact with the first layer of abrasive mixture on the opposite side with respect to the auxiliary mesh.

In a further aspect of the invention, a method is disclosed for realising a grinding wheel which comprises steps of:

inserting a support element internally of a forming cavity of a die, laying, internally of the forming cavity, a first reinforcing mesh resting on the support element, depositing a quantity of abrasive mixture internally of the forming cavity such as to at least partially incorporate the first reinforcing mesh in a first layer of abrasive mixture deposited, pressing the support element, the first reinforcing mesh and the first layer of abrasive mixture in order to obtain the grinding wheel.

In the invention, the support element comprises an auxiliary mesh a first face of which is supported restingly on a bottom wall of the forming cavity and the second face of which is in contact with the first reinforcing mesh in such a way as to maintain the first reinforcing mesh raised with respect to the bottom wall.

In practice, with the above method the above-mentioned results and advantages are attained in the obtained grinding wheel.

The laying of the first reinforcing mesh advantageously precedes the depositing of the abrasive mixture so as to realize the first layer of abrasive mixture internally of the cavity, the abrasive mixture in practice being distributed in the forming cavity in a first portion and in a second portion respectively lower and upper with respect to the first reinforcing mesh so as to incorporate the first reinforcing mesh internally thereof.

In practice, the second portion that penetrates between the mesh passages of the first reinforcing mesh is arranged between the links of the auxiliary mesh, creating a layer that posteriorly covers the whole first reinforcing mesh.

In a still further aspect of the invention, a further step is included of arranging a label (exhibiting a diameter equal to or smaller than the internal diameter of the forming cavity, for example between 70% and 90% thereof) on the bottom wall of the forming cavity at a same time as (for example, if glued or in any case rested) or before insertion of the auxiliary mesh in the forming cavity.

The forming cavity advantageously comprises at least a forming core of the attaching hole of the grinding wheel, rising from the bottom wall of the forming cavity and centered in the forming cavity, the auxiliary mesh and the first reinforcing mesh (as well as the label, if present) being inserted substantially coaxially on the forming core.

BRIEF DESCRIPTION OF THE DRAWINGS

Further characteristics and advantages of the invention will emerge from a reading of the description that follows, provided by way of non-limiting example, with the aid of the figures of the accompanying tables.

FIG. 9 is the section view of FIG. 7 of an alternative following step preceding the pressing of the first layer of abrasive mixture, the first reinforcing mesh and the auxiliary mesh contemporaneously with two second layers of abrasive mixture and respective second reinforcing meshes.

FIG. 10 is a section view of an embodiment of a flat grinding wheel according to the invention.

FIG. 11 is a section view of an embodiment of a depressed-center grinding wheel according to the invention.

DETAILED DESCRIPTION OF THE PREFERRED EMBODIMENTS

Figure 1:
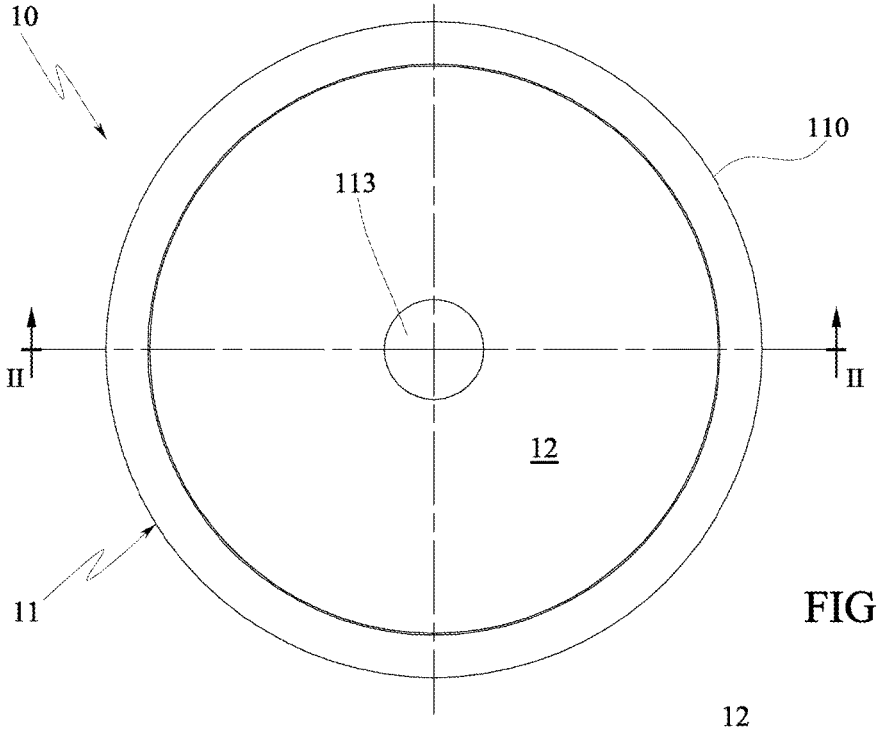
FIG. 1 is a view from above of a forming die for depressed-center grinding wheels according to the invention.
Figure 2:
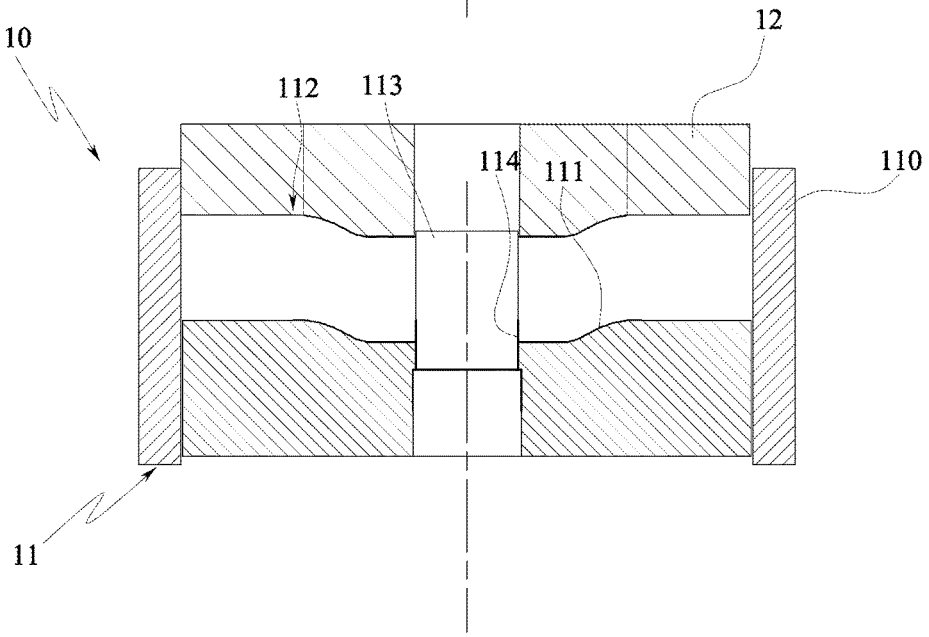
FIG. 2 is the view along section line II-II of FIG. 1.
Figure 3:
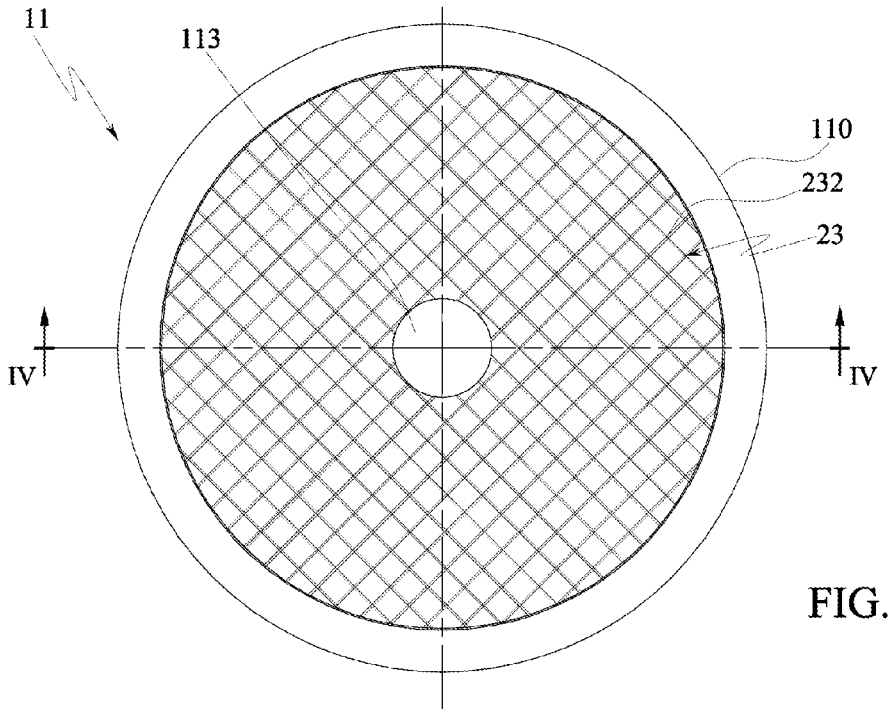
FIG. 3 is a view from above of the die of FIG. 1 in which the auxiliary mesh has been inserted.
Figure 4:
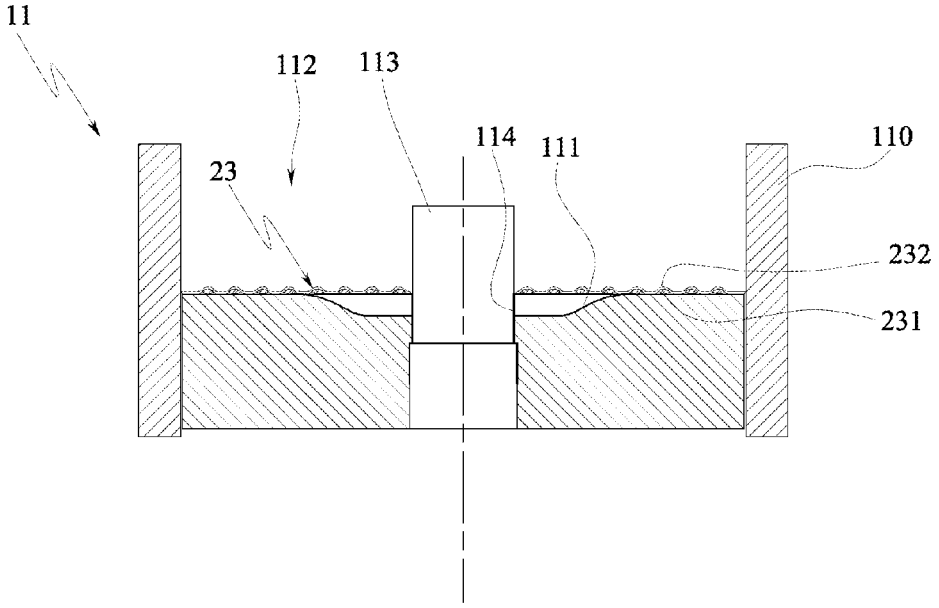
FIG. 4 is the view along section line IV-IV of FIG. 3.
Figure 5:
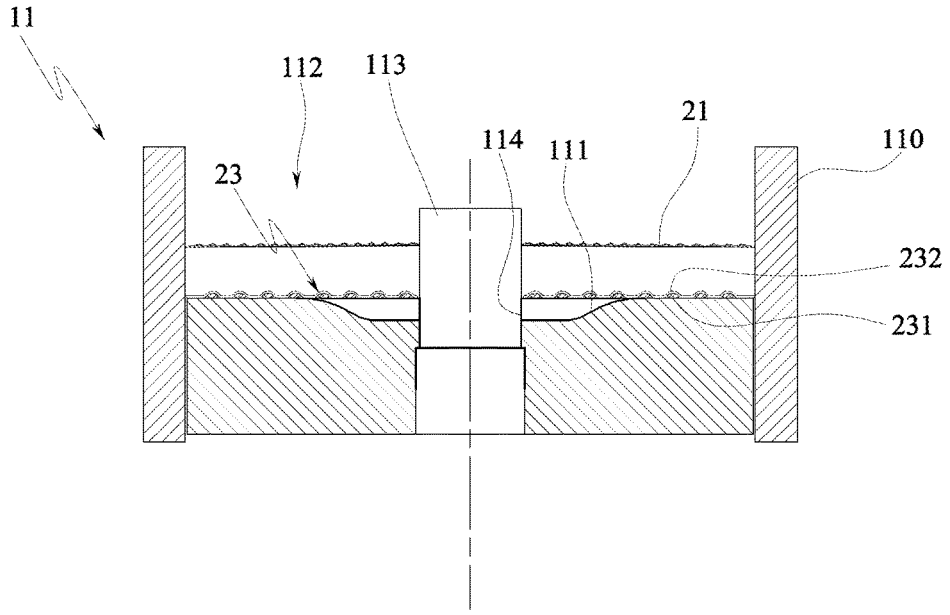
FIG. 5 is a section view of FIG. 4, during the laying step of the first reinforcing mesh in the die.
Figure 6:
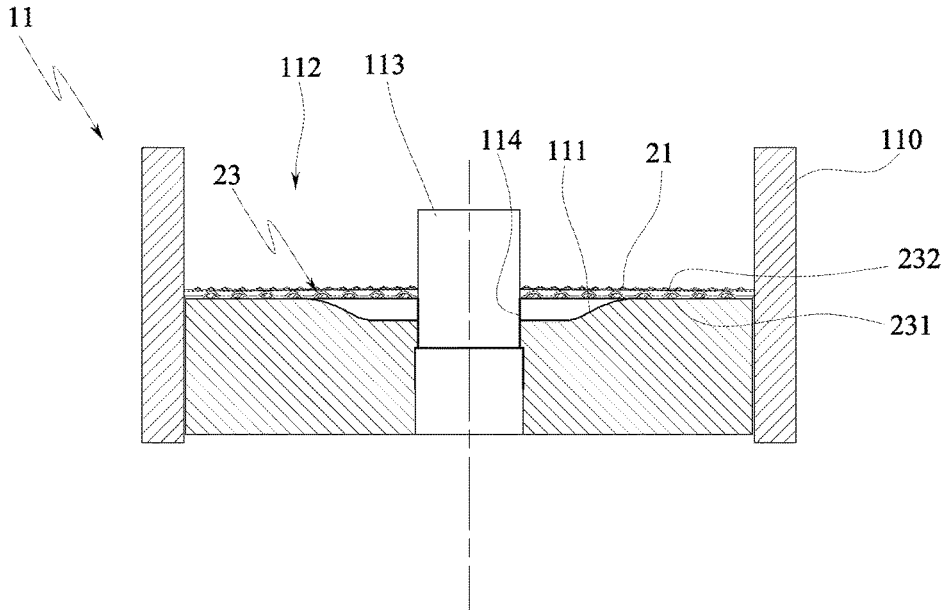
FIG. 6 is the section view of FIG. 5 in a subsequent step in which the first reinforcing mesh is resting on and in contact with the auxiliary mesh.
Figure 7:
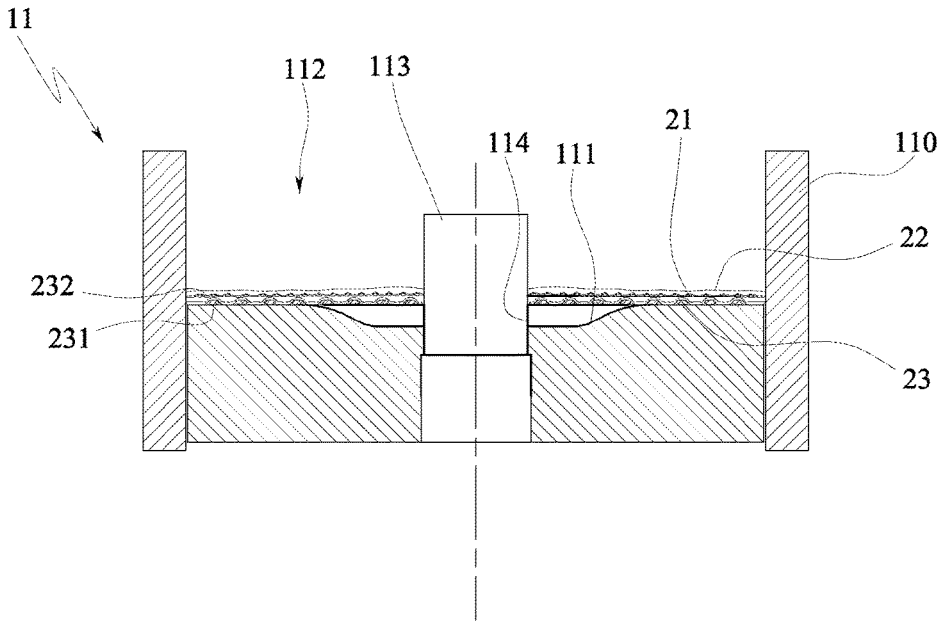
FIG. 7 is the section view of FIG. 6 following a subsequent step in which the first layer of abrasive mixture is deposited.
Figure 8:
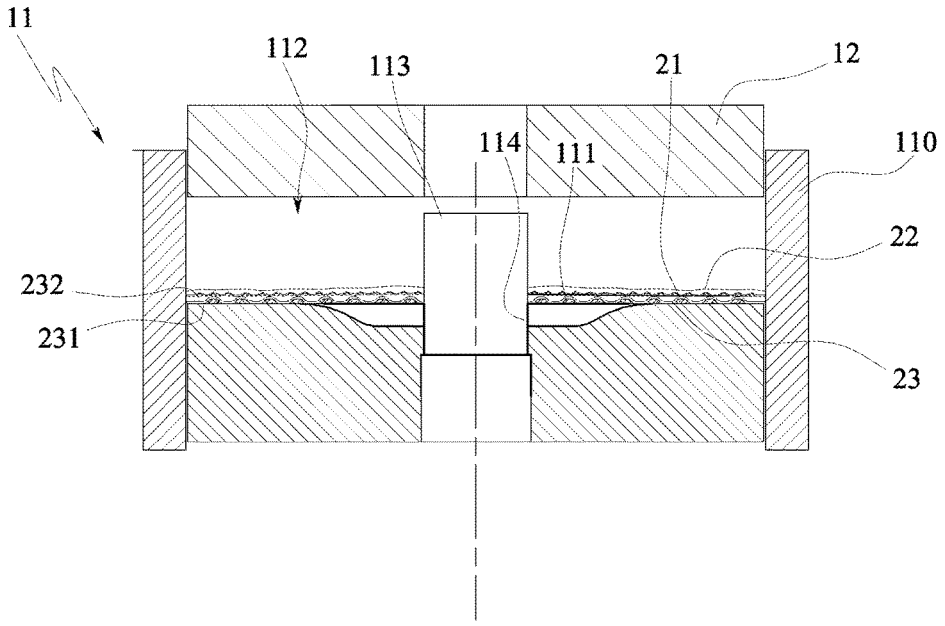
FIG. 8 is the section view of FIG. 7 in a following step preceding the pressing of the first layer of abrasive mixture, the first reinforcing mesh and the auxiliary mesh.

With particular reference to the figures, reference numeral 10 denotes in its entirety a die for forming grinding wheels (with depressed or flat centers), generally denoted by reference number 20.

The die 10 comprises a die matrix 11 positionable opposite a punch 12 for forming the grinding wheel 20.

The die matrix 11, for example, comprises a cylindrical sleeve 110 inferiorly closed by a bottom wall 111.

In practice, the bottom wall 111 comprises a disc-shaped body and a circumferential base for example made of a metal material able, for example, to be inserted substantially snugly internally of the cylindrical sleeve 110.

The bottom wall 111 and the cylindrical sleeve 110 delimit a forming chamber 112 open at a top thereof.

The bottom wall 111 is advantageously associated slidably with respect to the cylindrical sleeve 110 so that the internal volume of the forming chamber 112 can be varied by changing the axial position of the bottom wall 111 with respect to the cylindrical sleeve 110.

The bottom wall 111 centrally exhibits a centering pin 113 rising from the upper face thereof and coaxial with the cylindrical sleeve 110.

In particular, the centering pin 113 is inserted in a central hole 114 made in the bottom wall 111 and fixed therein.

The upper face of the bottom wall 111 can be substantially planar if a flat grinding wheel 20 is to be manufactured (or a semi-finished piece which will then be deformed so as to form a grinding wheel 20 with a depressed, "dimpled" center 100).

The upper face of the bottom wall 111 preferably comprises a central depression that is coaxial to the bottom wall and defines a central dimple, so as to overall define a concave bottom wall 111 for forming depressed-center grinding wheels 20.

In any case the bottom wall 111 defines a rest plane for the grinding wheel 20 to be formed that is substantially perpendicular to the axis of the cylindrical sleeve 110.

The punch 12, for example, comprises an annular/disc-shaped body, an external diameter of which is substantially equal to the external diameter of the bottom wall 111 of the die matrix 11 (i.e. a little smaller than the internal diameter of the cylindrical sleeve 110), so as to be insertable substantially snugly in the cylindrical sleeve 110 and to be superposed on the bottom wall.

In a case where a depressed-center grinding wheel 20 is to be formed, the punch 12 comprises a complementary shape to the bottom wall 111.

Further, in this case, the punch 12 can be realized as a monolithic body or by two annular concentric and separate bodies able to be axially activated independently in order for independent outer periphery and inner formation of the grinding wheel 20 to be achieved.

The punch 12 and the bottom wall 111 are movable towards/away from each other, respectively for closing/opening the forming cavity 112, as is known to a technical expert in the sector.

The grinding wheel 20 comprises a disc-shaped body (planar or preferably having a depressed center) provided with a central attachment hole 200, which is associated, substantially coaxially, to the free end of a rotating shaft of a grinding machine.

The disc-shaped body is made of a mixture of abrasive powders that are compacted and stably bound by a binder resin.

In practice, the disc-shaped body is obtained by pressing a mixture of a loose powder of abrasive material, for example abrasive material such as natural corundum, sand, recycled artificial corundum or the like, sol-gel abrasives or sintered ceramics, zircon-modified corundum, or others besides, and mixed with a suitable binder, such as resin-based binders, for example phenolic resins, in liquid and/or powder form and possibly modified with epoxy phenolic resins, and/or others, modified with organic compounds and/or vegetable or synthetic compounds, and other types of polyimide resins etc., and/or with additives and fillers.

The abrasive mixture has a particle size of substantially between 120 and 12 mesh (although the use of abrasive mixtures having particle sizes greater or smaller than the cited range, according to requirements, is not excluded).

The disc-shaped body comprises at least a first reinforcing mesh 21 substantially entirely incorporated in a first layer of abrasive mixture 22, for example an abrasive mixture as described above, pressed and fired.

In practice, the first layer of abrasive mix 22 surrounds, in particular axially, the entire surface (upper and lower) of the first reinforcing mesh 21.

The grinding wheel 20 also comprises a support element in contact with the first reinforcing mesh 21.

The support element is in particular made from an auxiliary mesh 23 exhibiting a first face 231 emerging at least partially from the first layer of abrasive mixture 22 and a second face 232 in direct contact with the first reinforcing mesh 21.

In practice, the first face 231 of the auxiliary mesh 23 emerges, being substantially flush with it, at the rear face of the grinding wheel 20 which is intended in use to be directed towards the work tool which sets the wheel 20 in rotation, opposite the front face of the grinding wheel 20 which will go into contact with the surface to be machined, for example by finishing.

The face of the first reinforcing mesh 21 in contact with the second face 232 of the auxiliary mesh 23 is distanced from the rear face of the grinding wheel 20 by an amount at least equal to the thickness of the auxiliary mesh 23.

The first layer of abrasive mixture 22, therefore, is made of a first portion 221 interposed (axially) between the rear face of the grinding wheel 20 and the first reinforcing mesh 21, in which the auxiliary mesh 23 is incorporated, and a second portion 222 interposed (axially) between the front face of the grinding wheel 20 and the first reinforcing mesh 21.

The auxiliary mesh 23 has larger mesh sizes than the first reinforcing mesh 21.

For example, the auxiliary mesh 23 exhibits meshes of between 1×1 cm and 3×3 cm, preferably 2×2 cm.

Furthermore, the auxiliary mesh 23 has a thickness of substantially between 0.5 and 2 mm, preferably 1 mm.

In practice, the first portion 221 of the first layer of abrasive mixture 22 has a thickness (axial) substantially equal to the thickness (axial) of the auxiliary mesh 23.

The auxiliary mesh 23 in practice is substantially disc-shaped with an outer diameter of substantially between 0.7 and 1 time the diameter of the grinding wheel 20, i.e. the inner diameter of the forming cavity 112.

In the illustrated example, the outer diameter of the auxiliary mesh 23 is substantially equal to the diameter of the grinding wheel 20, as well as the outer diameter of the first reinforcing mesh 21.

The internal diameter of the auxiliary mesh 23 is for example substantially between 1 and 1.3 times the diameter of the attachment hole 200, preferably the inner diameter of the auxiliary mesh 23 is substantially equal to the diameter of the attachment hole 200 (as well as the inner diameter of the first reinforcing mesh).

The grinding wheel 20 can include at least a second layer of abrasive mixture 24 which can comprise, incorporated in the interior thereof, a respective second reinforcing mesh 25.

The second layer of abrasive mixture 24 is substantially superposed on the first layer of abrasive mixture 22, on the opposite side thereof to the auxiliary mesh 23.

The second layer of abrasive mixture 24 can be of the same nature and/or particle size as the first layer of abrasive mixture 22, or can have a different nature and particle size, for example it can be realized with a more precious/harder or coarser abrasive material.

The abrasive mixture, for example, the first layer of abrasive mixture 22, exhibits a finer particle size than the abrasive mixture of the second layer of abrasive mixture 24.

For example, the fine abrasive mixture of the first layer of abrasive mixture 22 can exhibit a particle size substantially comprised between 60 and 46 mesh (although abrasive mixtures having a greater or smaller particle size than the cited range can be used, according to requirements) and the coarse abrasive mixture of the second layer of abrasive mixture 24 can exhibit a particle size of substantially between 24 and 12 mesh (although abrasive mixtures having a greater or smaller particle size than the cited range can be used according to the requirements).

A coarse grain size of up to 12 mesh and above of the second layer of abrasive mix 24 advantageously confers high abrading action on the grinding wheel 20.

Thus the first layer of abrasive mixture 22 can exhibit a smaller thickness than the second layer of abrasive mixture 24.

The second reinforcing net 24, incorporated in the second layer of abrasive mixture 22 (for example at the interface with the first layer of abrasive mixture 21), is substantially equal, in terms of the size of the mesh passages, to the first reinforcing mesh 21.

The grinding wheel 20 could also include a plurality of the second layers of abrasive mixture 24, superposed on one another and each encapsulating a respective second reinforcing mesh 25.

A paper or foil label 26 or like attachment can be attached on the rear face of the grinding wheel 20, which rear face is delimited by the first face 231 of the auxiliary mesh 23, which label 26 substantially annular and possibly occupies the entire rear face of the grinding wheel 20 or a limited radial portion thereof.

Lastly, the grinding wheel 10 comprises one or more metal annular elements, commonly known as washers or sleeves 27, which delimit the attachment hole of the grinding wheel 20 to the pin of the grinding machine.

The washer 27 is fixed to the rear face 13 of the grinding wheel 20 (or the label 26 where present), for example extending over a limited radial portion of the grinding wheel 20.

The washer 27 comprises a central hollow shank 270 that inserts substantially snugly into the through-hole 200 and which exhibits an axial thickness that is substantially identical to (or slightly smaller than) the axial thickness of the grinding wheel 20.

In the light of the above, the forming method for a grinding wheel 20 as described above includes the following steps.

Initially, for example, the washer 27 is inserted into the forming cavity 112, so that it inserts on the centering pin 113 and reclines on the bottom wall 111 (for example on the peripheral portion thereof), with the hollow central shank 270 rising from the bottom wall thereof.

Subsequently, the label 26, when provided, is laid on the bottom wall 111 and/or on the washer 27.

Simultaneously (for example if they have been pre-glued or pre-flanked) or subsequently, the auxiliary mesh 23 is inserted into the forming cavity 112, for example resting on the bottom wall 111 (directly or with the interposing of the label 26).

The auxiliary mesh 23 is also inserted on the centering pin 113, so that it is substantially coaxial to the forming cavity 112.

Simultaneously (for example if they have been pre-glued or pre-flanked), or after the insertion of the auxiliary mesh 23, the first reinforcement net 21 is deposited internally of the forming cavity 112, so that it goes directly to rest on the auxiliary mesh 23, i.e. in contact therewith (for example at discrete points distributed more or less uniformly over the second face 232 of the auxiliary mesh 23, for example at the nodes of the auxiliary mesh 23) without the interposing of intermediate elements or layers of abrasive material or other elements.

The first auxiliary mesh 21 is also inserted on the centering pin 113, so that it is substantially coaxial to the forming cavity 112.

In practice, there are no other steps of insertion/laying/deposit of elements in the forming cavity 112 between the laying of the first reinforcement net 21 and the insertion of the auxiliary mesh 23.

The first reinforcing net 21 therefore remains substantially suspended internally of the forming cavity 112 at a distance from the bottom wall 111 (and/or from the label 26) stably resting on the auxiliary mesh 23.

Once the first reinforcement net 21 has been laid, a quantity of abrasive mixture is deposited internally of the forming cavity 21 (in a depositing station of the abrasive powder) so as to at least partially incorporate the first reinforcing mesh 21 in a first layer of deposited abrasive mixture 22.

In practice, the amount of abrasive mixture that forms the first layer of abrasive mixture 22 fills the forming cavity 112 to an axial thickness that exceeds the lie plane of the first reinforcing mesh 21, so that the mesh 21 becomes completely incorporated in the first layer of abrasive mixture 21.

In practice, the abrasive mixture that constitutes the first layer of abrasive mixture 21, which is deposited for example in a single act/cast, is distributed by passing between the meshes of the first reinforcing mesh 21 and the auxiliary mesh 23 on the bottom wall 111 and ideally is subdivided in its axial thickness into the first portion 221, which partially incorporates the auxiliary mesh 23 (lying between the meshes thereof) and is delimited inferiorly by the bottom wall 111 and superiorly by the interface between the first reinforcing mesh 21 and the auxiliary mesh 23, and in the second portion 222, which is inferiorly delimited by the interface between the first reinforcing mesh 21 and the auxiliary mesh 23, and is superiorly free.

In practice the first and the second portion 221, 222 together incorporate the first reinforcing mesh 21 internally thereof.

In a case where the forming plant and the method of the grinding wheel 20 have only a single depositing station of abrasive mixture, i.e. the grinding wheel 20 exhibits a single layer of abrasive mixture (in the present case divided into the two portions 221, 222), the auxiliary mesh 23, the first reinforcing mesh 21 and the first layer of abrasive mixture 21 deposited in the forming cavity are pressed so as to obtain the grinding wheel 20 (unfired semi-finished piece) of the desired shape (flat or depressed center).

The pressing takes place by action of the reciprocal nearing between the punch 12 and the bottom wall 111.

Finally, the grinding wheel 20 thus-formed is subjected to a baking heat treatment, for example in special polymerization ovens, where the polymerization is completed of the binder resin that solidifies and stably retains the abrasive mixture constituting the grinding wheel (i.e. the disc-shaped body it is constituted by).

In practice, the grinding wheel 20 is subjected to a heat cycle which includes insertion thereof in an oven at a temperature of substantially between 120° and 220° C. for a time substantially comprised between 1 and 50 hours, or is fired in situ by heating the die 10.

If, however, the forming method and the plant includes two, three or more depositing stations, or the finished grinding wheel 20 must exhibit a plurality of superimposed layers of abrasive material, before subjecting the grinding wheel 20 to pressing and baking the following steps are carried out.

A second reinforcing mesh 25 is laid on the first layer of abrasive material 22 deposited in the forming cavity 112 (open).

Once the second reinforcement mesh 25 is laid a second layer of abrasive material 24 is also laid (e.g. of coarser grain than the first layer of abrasive material 22), so as to incorporate and totally cover the second reinforcing mesh 25.

At this point one or more additional second reinforcement meshes 25 can be laid in the forming cavity 112 (for example coaxially inserted on the centering pin 113) and respective one or more second layers of abrasive mixture 24 can be deposited, effectively totally covering and incorporating the meshes to the desired thickness.

Further, the sandwich structure of the grinding wheel 20 can be completed with a further second reinforcing mesh 24, not incorporated in a further layer of abrasive material, but which during the pressing penetrates at least partially internally of the (first or second) layer of abrasive mixture lying immediately below it.

Lastly, the forming of the grinding wheel 20 is completed by the pressing of the contents of the above-described die 10, the release of the pressed semi-finished piece and the eventual baking of the grinding wheel 20.

The invention as it conceived herein is susceptible to numerous modifications and variations, all within the scope of the inventive concept.

Moreover, all the details are replaceable by other technically equivalent elements.

In practice, the materials used, as well as the contingent shapes and dimensions, can be any according to requirements, without forsaking the scope of protection of the following claims.

What is claimed is:

1. A grinding wheel (20) comprising at least a first reinforcing mesh (21) completely incorporated into at least a first layer of abrasive mixture (22) and at least a support element in contact with the first reinforcing mesh (21), wherein the support element comprises an auxiliary mesh (23) provided with a face (232) in direct contact with the first reinforcing mesh (21), wherein the auxiliary mesh (23) exhibits a larger mesh size than the first reinforcing mesh (21), and a further face (231) of the auxiliary mesh (23) at least partially emerges from the first layer of abrasive mixture (22).

2. The grinding wheel (10) of claim 1, wherein the auxiliary mesh (23) exhibits links between 1×1 cm and 3×3 cm.

3. The grinding wheel (10) of claim 1, wherein the auxiliary mesh (23) exhibits a thickness substantially between 0.5 and 2 mm.

4. The grinding wheel (10) of claim 1, wherein the auxiliary mesh (23) is substantially disc-shaped with an external diameter that is substantially between 0.7 and 1.0 of the external diameter of the abrasive mixture (22).

5. The grinding wheel (10) of claim 1, further comprising at least a second reinforcing mesh (25) incorporated in a respective second layer of abrasive mixture (24), wherein at least one from between the second reinforcing mesh (25) and the second layer of abrasive mixture (24) is in contact with the first layer of abrasive mixture (22) on an opposite side with respect to the auxiliary mesh (23).

6. The grinding wheel (10) of claim 1, wherein a further face (231) of the auxiliary mesh (23), opposite to the face (232) in direct contact with the first reinforcing mesh (21), is directed towards a work tool which sets the grinding wheel (20) in rotation when the grinding wheel (20) is in use and is opposite to a front face of the grinding wheel (20) which will go into contact with a surface to be machined by the grinding wheel (20).

7. The grinding wheel (10) of claim 1, wherein the further face (231) of the auxiliary mesh (23) emerges at a rear face of the grinding wheel (20), wherein the rear face is intended to face a work tool which sets the grinding wheel (20) in rotation and is opposite to the front face of the grinding wheel (20) which will go into contact with a surface to be machined.

8. The grinding wheel (10) of claim 1, comprising one metal annular element (27) which delimit an attachment hole of the grinding wheel (20) to the pin of a grinding machine, the metal annular element (27) being fixed to a rear face of the grinding wheel (20) from which the auxiliary mesh (23) emerges.

9. The grinding wheel (10) of claim 1, wherein an annular paper or foil label (26) is attached on a rear face of the grinding wheel (20).

10. The grinding wheel (10) of claim 1, wherein the first layer of abrasive mixture (22) is made of a first portion (221) axially interposed between a rear face of the grinding wheel (20) and the first reinforcing mesh (21), in which the auxiliary mesh (23) is incorporated, and a second portion (222) axially interposed between a front face of the grinding wheel (20) and the first reinforcing mesh (21).

11. A method for realizing a grinding wheel (20) comprising the steps of:

inserting a support element internally of a forming cavity (112) of a die (10), laying, internally of the forming cavity (112), a first reinforcing mesh (21) resting on the support element, depositing a quantity of abrasive mixture internally of the forming cavity (112) such as to at least partially sink the first reinforcing mesh (21) in a first layer of abrasive mixture (22) deposited, pressing the support element, the first reinforcing mesh (21) and the first layer of abrasive mixture (22) in order to obtain the grinding wheel (20), wherein the support element comprises an auxiliary mesh (23) a first face (231) of which is supported restingly on a bottom wall (111) of the forming cavity (112) and a second face (232) of which is in contact with the first reinforcing mesh (21) in such a way as to maintain the first reinforcing mesh raised with respect to the bottom wall (111), wherein the auxiliary mesh (23) exhibits a larger mesh size than a mesh size of the first reinforcing mesh (21).

12. The method of claim 11, wherein the laying of the first reinforcing mesh (21) precedes the depositing of the abrasive mixture so as to realize the first layer of abrasive mixture (22), the abrasive mixture being distributed in the forming cavity (112) in a first portion (221) and in a second portion (222) respectively lower and upper with respect to the first reinforcing mesh (21) so as to incorporate the first reinforcing mesh (21) internally thereof.

13. The method of claim 11, further comprising a step of arranging a label (26) on the bottom wall (111) of the forming cavity (112) at a same time as or before insertion of the support element in the forming cavity.

14. The method of claim 11, wherein the forming cavity (112) comprises at least a forming core (113) of the attaching hole (200) of the grinding wheel (20), rising from the bottom wall (111) of the forming cavity (112) and centered in the forming cavity, the auxiliary mesh (23) and the first reinforcing mesh (21) being inserted substantially coaxially on the forming core (113).

* * * * *